US010485319B2

(12) United States Patent
Fereyre et al.

(10) Patent No.: US 10,485,319 B2
(45) Date of Patent: Nov. 26, 2019

(54) DEVICE FOR TREATING THE HAIR AND ASSOCIATED REFILL

(71) Applicants: L'OREAL, Paris (FR); SEB S.A., Ecully (FR)

(72) Inventors: Régis Fereyre, Chavanay (FR); Franck Mandica, Francheville (FR); Stefania Nuzzo, Paris (FR)

(73) Assignees: L'OREAL, Paris (FR); SEB S.A., Ecully (FR)

( * ) Notice: Subject to any disclaimer, the term of this patent is extended or adjusted under 35 U.S.C. 154(b) by 580 days.

(21) Appl. No.: 15/108,500

(22) PCT Filed: Dec. 19, 2014

(86) PCT No.: PCT/IB2014/067150
§ 371 (c)(1),
(2) Date: Jun. 27, 2016

(87) PCT Pub. No.: WO2015/097624
PCT Pub. Date: Jul. 2, 2015

(65) Prior Publication Data

US 2016/0324291 A1 Nov. 10, 2016

(30) Foreign Application Priority Data

Dec. 26, 2013 (FR) ..... 13 63586

(51) Int. Cl.
*A45D 1/02* (2006.01)
*A45D 19/02* (2006.01)
(Continued)

(52) U.S. Cl.
CPC ..... *A45D 19/02* (2013.01); *A45D 1/04* (2013.01); *A45D 2/001* (2013.01); *A45D 2/002* (2013.01);
(Continued)

(58) Field of Classification Search
CPC ..... A45D 1/04; A45D 1/008; A45D 2/001; A45D 2/002; A45D 2/00; A45D 19/02
See application file for complete search history.

(56) References Cited

U.S. PATENT DOCUMENTS

2009/0025247 A1 1/2009 Yde et al.
2010/0307528 A1 12/2010 Restle et al.
2013/0192625 A1* 8/2013 Migliori ..... A45D 2/001 132/211

FOREIGN PATENT DOCUMENTS

EP 2449909 A1 5/2012
FR 2952512 A1 5/2011
(Continued)

OTHER PUBLICATIONS

Mar. 26, 2015 International Search Report issued in International Patent Application No. PCT/IB2014/067150.
(Continued)

*Primary Examiner* — Rachel R Steitz
(74) *Attorney, Agent, or Firm* — Oliff PLC

(57) ABSTRACT

The present invention relates to a refill (20) for an appliance for treating the hair, comprising:

Figure 1:
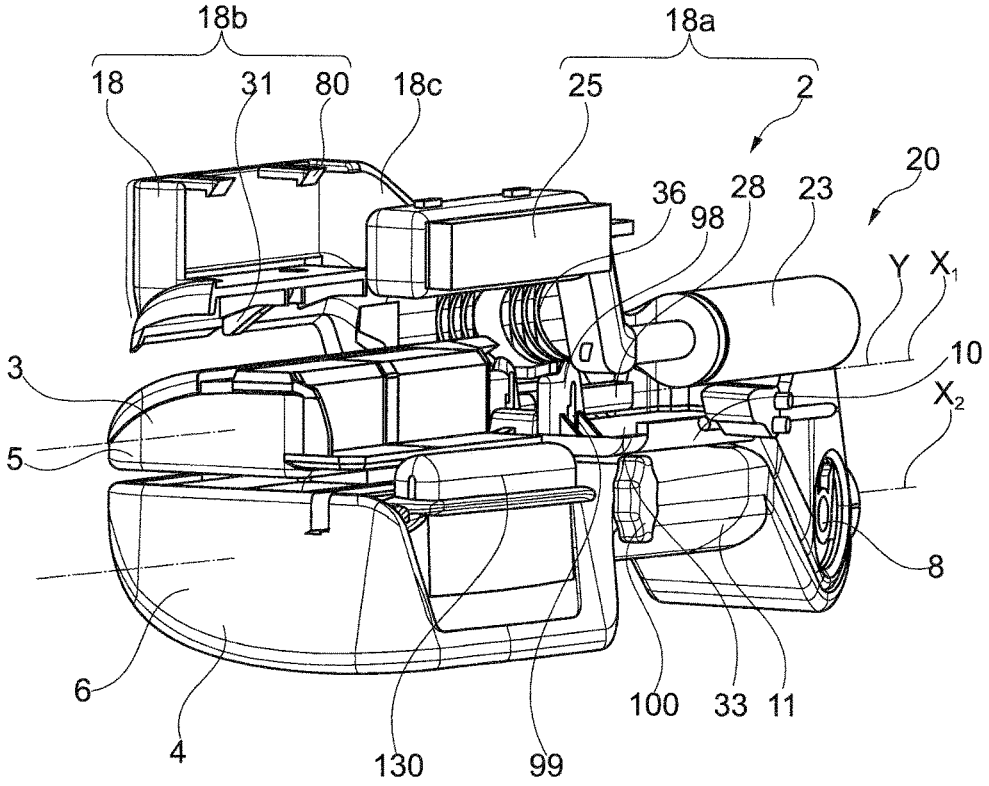

a reservoir (23) containing a haircare product and comprising a rigid or semi-rigid body (86) in contact with the product, and an end piece (53) for dispensing the product contained in the reservoir (23), a fluidic connection disposed between the dispensing end piece (53) and the reservoir (23), a support (83) for the dispensing end piece (53), the fluidic connection and at least a part of the reservoir (23), this support being produced in an integral manner, the refill (20) extending along a longitudinal axis (Z),
(Continued)

the length (l) of the support (83), measured along said longitudinal axis (Z), being less than that ($L_{rech}$) of the refill (20).

27 Claims, 7 Drawing Sheets

(51) Int. Cl.

| | |
|---|---|
| ***A45D 1/04*** | (2006.01) |
| ***A45D 2/00*** | (2006.01) |
| ***A45D 19/16*** | (2006.01) |
| *A45D 34/00* | (2006.01) |

(52) U.S. Cl.
CPC ..... *A45D 19/16* (2013.01); *A45D 2034/005* (2013.01)

(56) References Cited

FOREIGN PATENT DOCUMENTS

| | | | |
|---|---|---|---|
| FR | 2967018 | A1 | 5/2012 |
| WO | 2009/015027 | A2 | 1/2009 |
| WO | 2009/078046 | A1 | 6/2009 |
| WO | 2014/064660 | A1 | 5/2014 |

OTHER PUBLICATIONS

Mar. 26, 2015 Written Opinion issued in International Patent Application No. PCT/IB2014/067150.

* cited by examiner

DEVICE FOR TREATING THE HAIR AND ASSOCIATED REFILL

The present invention relates to devices for treating the hair, and more particularly, but not exclusively, those intended for shaping the hair, in particular for straightening, curling or crimping the hair, comprising a refill of cosmetic product.

BACKGROUND

Usually, hair straighteners consist of two arms that are connected together with the aid of a hinge which makes it possible to open and close said arms, and of at least one heating element disposed on the arms. During operations of styling a lock of hair, said lock is introduced between the two arms in the open position and then the two arms are closed manually over the lock of hair. The lock of hair is then subjected, until the two arms are opened and the lock of hair is removed, to the heat output by the heating element.

The application WO 2009/078046 describes a hairstyling appliance comprising two arms that are connected together so as to allow the appliance to be opened and closed, at least one heating member and at least one seat for accommodating a hair treatment device, the hair treatment device allowing a haircare product to be dispensed during operation. The hair treatment device is composed of a support material impregnated with a haircare product and suitable for a single use.

WO 2009/015027 and US 2009/0025247 disclose a hair straightening device that makes it possible to apply a haircare product by contact with the hair. The haircare product to be applied is contained in a removable refill for the application thereof. The removable refill comprises a reservoir containing the haircare product in a gelled form, and orifices for dispensing and applying the product, said orifices being made directly through a wall of the reservoir. The refill is introduced into a housing disposed on one of the two arms of the hair straightener, by sliding.

There is a need to further improve devices for applying a haircare product such that the user can easily refill the device with haircare product and/or change the haircare product to be applied.

There is also an advantage in having a sufficient quantity of haircare product to apply without changing the refill so as to make it possible not only to style thicker hair but also to reuse a single refill a number of times.

SUMMARY

According to a first of its aspects, a subject of the invention is a refill for an appliance for treating the hair, comprising:

- a reservoir containing a haircare product,
- an end piece for dispensing the product contained in the reservoir,
- a fluidic connection disposed between the dispensing end piece and the reservoir,
- a support for the dispensing end piece, the fluidic connection and at least a part of the reservoir, this support being produced in an integral manner, the refill extending along a longitudinal axis, the length of the support, measured along said longitudinal axis, being less than that of the refill.

The reservoir in the refill makes it possible to have a quantity of haircare product that is sufficient for dispensing a plurality of doses of product.

The presence of the support makes it possible to have a refill that is formed in one piece. This makes it easier to handle and to incorporate into the device. The support may also help to protect the reservoir and the dispensing end piece from the outside environment.

The fluidic connection makes it possible to supply the dispensing end piece with haircare product contained in the reservoir.

Preferably, the integral support is made of a rigid material, in particular polystyrene (PS), or else polyethylene (PE), polypropylene (PP) or acrylonitrile butadiene styrene (ABS). It is preferably moulded in one piece from thermoplastic material.

Preferably, the integral support is rigidly connected to the reservoir and carries the dispensing end piece. The integral support may define a housing intended to receive the dispensing end piece.

Preferably, the internal volume of the reservoir varies while the refill is being used. This can minimize the intake of air, and improve the preservation of the product.

The reservoir may extend along a longitudinal axis and have a single outlet for product at one end.

The maximum capacity of the reservoir is preferably between 2 ml and 20 ml.

The haircare product is preferably in the fluid state, that is to say liquid, at room temperature or a higher temperature, between 25 and 95° C. for example. In this case, the product can initially be in the solid or pasty state at room temperature in the reservoir and be heated up within the reservoir in order to make it sufficiently fluid to be dispensed by a dispensing mechanism provided to supply the applicator member. The product is thus fluid in the reservoir at the time of application. Preferably, the product is liquid at room temperature.

When the product is initially solid in the refill and heated in order to be fluidized, the region around the applicator member is preferably non-heating so as to more easily control the temperature of the product.

The length of the reservoir is preferably less than or equal to half the total length of the refill, measured along said longitudinal axis. This makes it easier to handle the refill.

The reservoir preferably comprises a rigid or semi-rigid body in contact with the product. The rigidity of the reservoir makes it possible to have a rigid refill and makes it easier to handle and use in the appliance.

The expression "rigid body" should be understood as meaning a body having sufficient rigidity to allow a follower piston to move inside the reservoir. The rigid body may be made of crystal polystyrene (PS), polycarbonate (PC) or polyethylene (PE), for example.

At least a part and better still all of the rigid or semi-rigid body of the reservoir on the one hand and the support on the other hand may be produced in an integral manner, in one piece by moulding material.

The rigid or semi-rigid body of the reservoir may have a tubular shape with a circular or some other section.

Preferably, the reservoir comprises a follower piston, the latter preferably moving unidirectionally, in particular by virtue of the presence of an anti-recoil system.

In a variant, the reservoir may have a rigid body provided with a longitudinal opening to which a flexible, in particular deformable, wall is attached. When the internal volume of the reservoir decreases, the flexible wall tends to mould itself to the rigid body of the reservoir.

Preferably, the reservoir has at least one longitudinally extending relief, for example in the form of a groove, allowing the product to flow from one end of the reservoir to the other, in particular when the flexible wall moulds itself to the rigid body of the reservoir.

The dispensing end piece and the reservoir preferably have respective longitudinal axes that are not coincident, and in particular are parallel and offset by a distance of between 10 mm and 40 mm, better still between 24 mm and 32 mm. This can make it easier to produce the refill and the appliance intended to receive it.

The dispensing end piece may be connected to the reservoir by a flexible duct, forming all or part of the fluidic connection between the reservoir and the dispensing end piece. An extension of this flexible duct may at least partially define the dispensing end piece.

The reservoir may be provided with a dip tube, in particular in the absence of a follower piston. This dip tube may be formed by a portion of the abovementioned flexible duct.

The dispensing end piece is preferably pre-filled with the haircare product. This can avoid the need to actuate a dispensing mechanism a number of times before the refill is used for the first time.

In a variant, the dispensing end piece can be filled at least partially, and better still entirely, with product while the refill is being introduced into an appliance, in particular when the internal volume of the reservoir decreases when the refill is fitted in an appliance.

The dispensing end piece may have at least one dispensing orifice, better still a plurality of dispensing orifices, which are in particular closed at rest and can open under the pressure exerted by the haircare product. The dispensing orifice(s) is/are preferably made through a wall, which is in particular deformable, preferably a wall defined by a flexible duct.

The or each dispensing orifice may be formed by a slot having edges that are joined at rest.

The volume of haircare product delivered at the dispensing end piece on each actuation of the dispensing mechanism may be between 0.01 ml and 0.5 ml.

The refill preferably comprises an applicator member that is supplied with product by the dispensing end piece, the applicator member being carried by the integral support and preferably at least partially covering the dispensing end piece. The applicator member may comprise a porous material and/or a material that is able to release or diffuse the cosmetic product, in particular an open-cell foam. If desired, the applicator member may be produced with a relatively small thickness, for example less than or equal to 10 mm.

The applicator member may be mounted in a fixed or removable manner on the integral support, at least partially covering the dispensing end piece, the integral support having at least one opening that is superposed at least partially on the dispensing end piece and allows the product to pass from the dispensing end piece to the applicator member. Preferably, the applicator member comes into contact with the dispensing end piece.

The applicator member may be held on the integral support by a holding element fixed to the integral support and disposed on the housing containing the dispensing end piece.

The dispensing end piece is preferably made so as to be filled with product when the dispensing mechanism is actuated, by increasing in volume by elastic deformation under the pressure of the product. Thus, product can collect in the dispensing end piece in order to be dispensed once the filling action has stopped. This makes it possible to supply the applicator member in a delayed manner, to avoid the need to collect a large amount of product within the applicator member itself, and thus to reduce losses of product during the changing thereof.

The fluidic connection preferably comprises one or more components of a pump for supplying the dispensing end piece with product coming from the reservoir, in particular at least one peristaltic pump tube or a flap-valve pump.

The peristaltic pump tube may be formed by a portion of the flexible duct that connects the dispensing end piece to the reservoir.

Preferably, the flexible duct extends along the refill and comprises an end portion that defines the dispensing end piece, an intermediate portion that defines the peristaltic pump tube and a possible end portion that defines the dip tube into the reservoir.

The refill may comprise a member for closing it when not in use, in particular a membrane seal or cover intended to at least partially cover the applicator member.

A further subject of the invention is a device for treating the hair, comprising:

- at least two arms that are able to move relative to one another between a moved-together configuration for treating the hair and a spaced-apart configuration for inserting a lock of hair to be treated between said arms,
- a refill according to the invention, the refill being disposed in a removable manner on one of the two arms.

The use of a refill allows the user to be able to apply different haircare products easily by simply changing the refill.

The two arms extend along respective longitudinal axes and are preferably connected by a hinge present at their proximal end, this hinge defining a rotation axis that is oriented preferably perpendicularly to a plane defined by the longitudinal axes of the arms.

The two arms may define half-handles that are extended towards their distal end by jaws.

The maximum thickness of the arms, measured at the jaws, is preferably greater than that measured at the half-handles; the maximum thickness of each arm is preferably between 10 and 40 mm, better still between 17 mm and 32 mm.

The moving together of the arms preferably actuates the pump for supplying the dispensing end piece with product.

The arm carrying the refill may have a relief designed to engage with the reservoir in order to cause the internal volume thereof to decrease when the refill is fitted on the device. The relief may be designed to move the piston forward when the refill is mounted on the arm. This makes it possible to pre-fill the dispensing end piece during the introduction of the refill into the device, such that the product is delivered from the first time the arms are moved together.

The refill may be received in a housing for incorporating the refill into the arm.

The device may have an electrical switch on the same arm as the refill, said switch being actuated by the refill, making it possible in particular to detect the presence of the refill on the arm.

The refill may have a portion that is visible from the outside of the device when the refill is in place on said arm. The refill, in particular the integral support, may have at least one extension that leads to the outside of the arm, preferably a lateral extension that juts out from or is flush with the side of the arm, in particular the side opposite the articulation of the flap on the arm. This allows a user to see that the refill is present on the arm.

The integral support may have an extension that is visible from the outside of the device when the refill is in place on said arm. This makes it possible to signal the presence of the refill to the user, and may also make it possible to identify it, if appropriate.

The housing may have an opening that extends preferably along the longitudinal axis of the arm, giving onto the other arm, this opening allowing the application of the haircare product, in particular through the applicator member carried by the refill.

The applicator member is disposed so as to come into contact with the hair when the arms are closed. The arm opposite the one carrying the refill may define a counter-bearing surface such that the hair is pressed against the applicator member with a certain pressure by the counter-bearing surface.

Preferably, the device is produced such that the applicator member is supplied automatically with product while the device is being used. Thus, the user does not have to worry about exerting a particular action on the device in order to apply the product. The closure of the arms can actuate the pump, which makes it possible to supply the applicator member with product, in particular with a dose of product. A dose of product is preferably between 0.01 ml and 0.5 ml.

The applicator member is preferably supplied with product with provisional collection of product under pressure by the dispensing end piece. The presence of product under pressure within the dispensing end piece, once the jaws have been moved together, makes it possible to continue supplying the applicator member with product while the device is moved along a lock of hair with the jaws moved together.

The arm opposite the one that carries the refill may have a steam outlet, and preferably also a comb. It may prove advantageous to use two combs, located respectively downstream and upstream of the region for applying the cosmetic product, so as to promote the homogeneous distribution of the product on the hair.

These combs are advantageously parallel to one another and may have the same number of teeth.

If appropriate, the device is produced so as to allow at least one of the combs, better still each comb, to be fastened in a removable manner.

Preferably, in particular when the hair is intended to be straightened, the device comprises a heating element intended to come into contact with the hair, and better still two heating elements, each disposed on an arm. This or these heating element(s) may each comprise a plate, made of a material that is a good conductor of heat, that defines a hot surface for bringing into contact with the hair, the temperature of said surface being for example greater than or equal to 95° C., better still between 90 and 230° C.

Preferably, product is applied to the lock of hair introduced into the device prior to the application of steam and/or combing and/or straightening by the heating element(s). Thus, the hair introduced between the arms can come into contact with the applicator member before being exposed to the steam and to the heating elements while the lock is being moved between the arms of the device.

A further subject of the invention is a refill for an appliance for cosmetic treatment, which may have the other features of the previously defined refill according to the invention, comprising:

a reservoir containing a product, and an end piece for dispensing the product contained in the reservoir, extending along a longitudinal axis, the dispensing end piece having a plurality of dispensing orifices, an applicator member for the product contained in the dispensing end piece, at least one of the size of the dispensing orifices and the density of the dispensing orifices being variable along the longitudinal axis, so as to homogenize the product on the surface of the applicator member.

The dispensing end piece is supplied with product through one of its longitudinal ends and tends to release more product through the dispensing orifices that are close to the end for supplying with product than through the distant orifices.

It is possible to respond to this problem by varying the main features of the dispensing of product through the dispensing end piece and the applicator member, namely the size and/or density of the dispensing orifices. By correctly choosing the variations, the distribution of product over the applicator member can be homogeneous.

The dispensing orifices are preferably formed by slots having joined edges, said slots being distributed along the dispensing end piece. The length of the dispensing orifices may increase with increasing distance from the reservoir.

The density of dispensing orifices may increase with increasing distance from the reservoir.

The device for treating the hair may be a straightener having flat heating elements, in particular which come into contact in the closed position.

Figure 2:
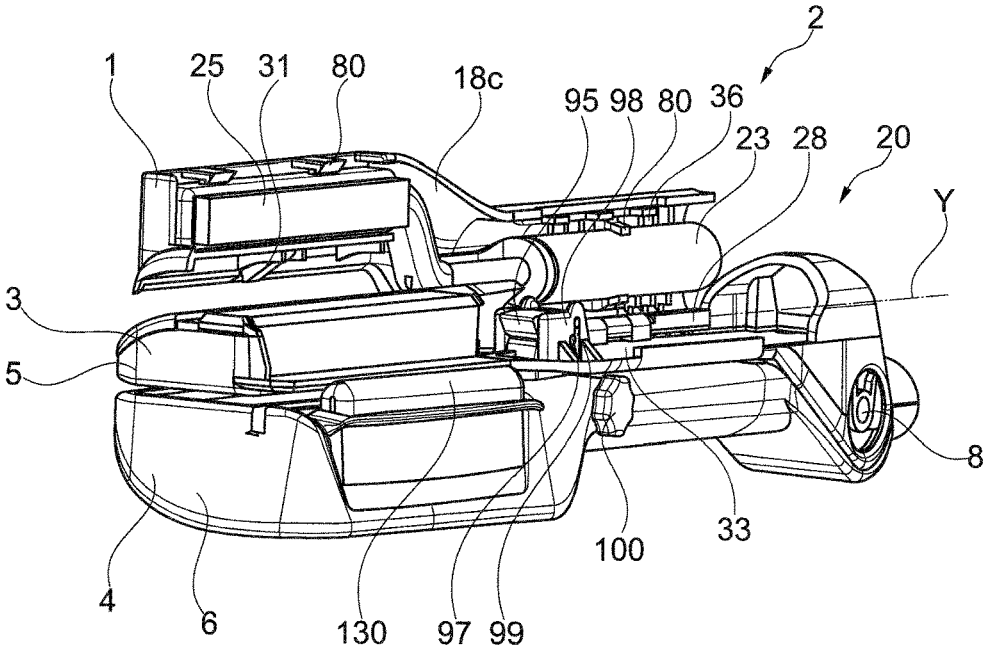
Figure 3:
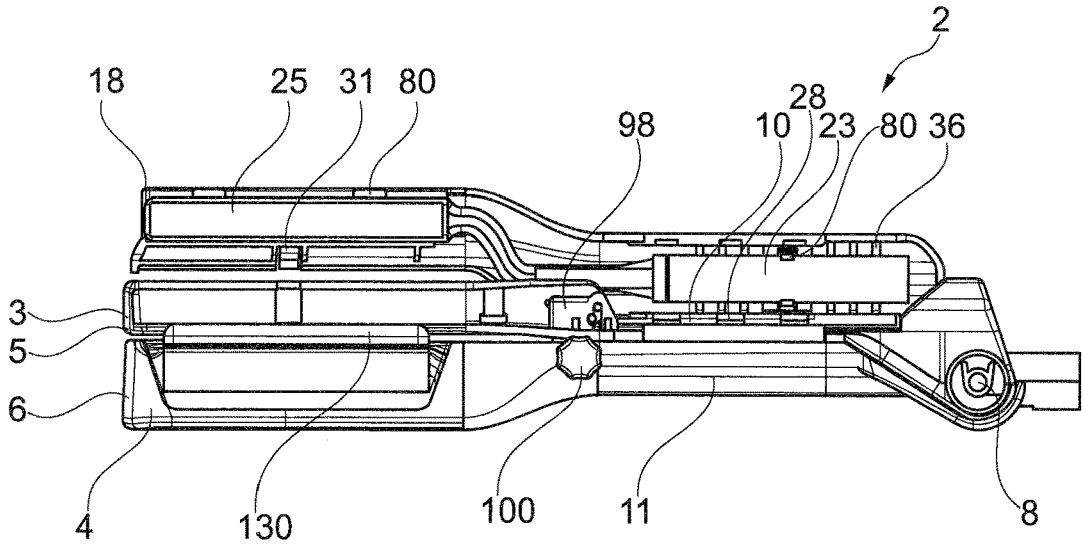
Figure 4:
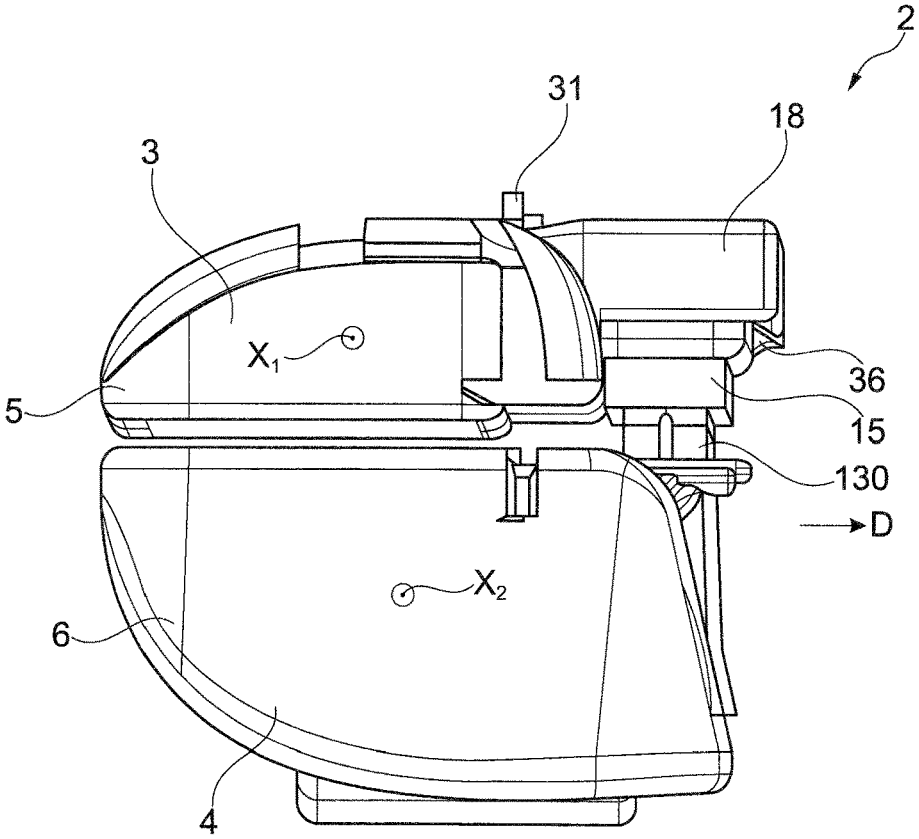
Figure 5:
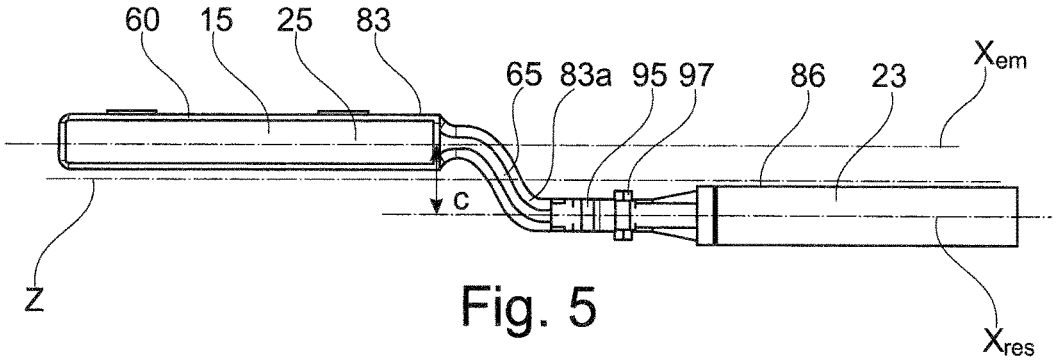
Figure 6:
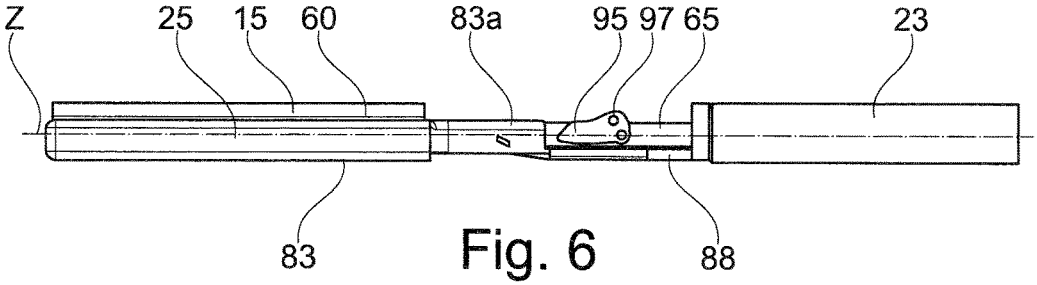
Figure 7:
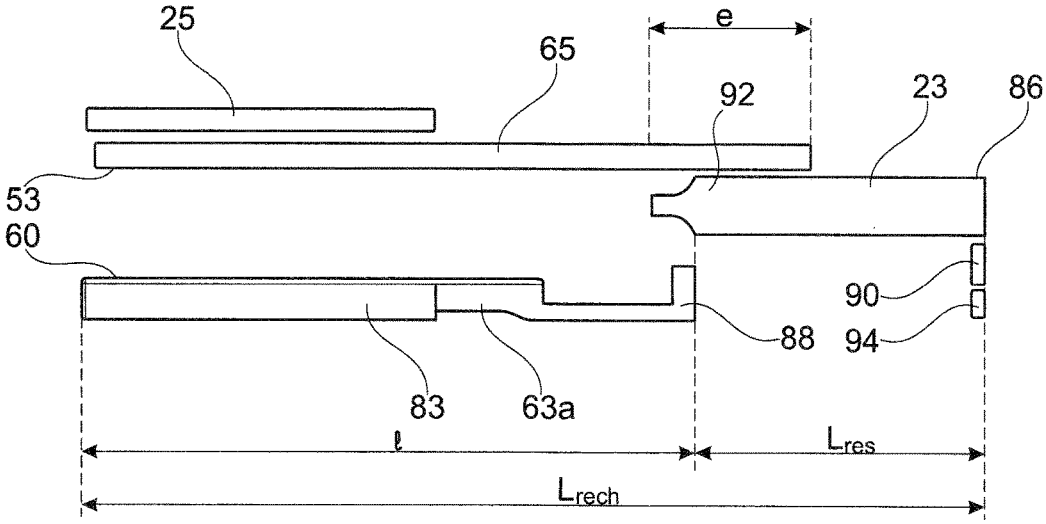
Figure 8A:
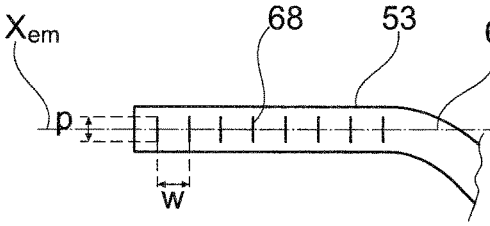
Figure 8B:
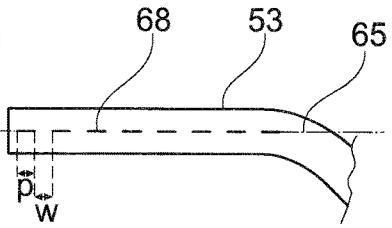
Figure 9:
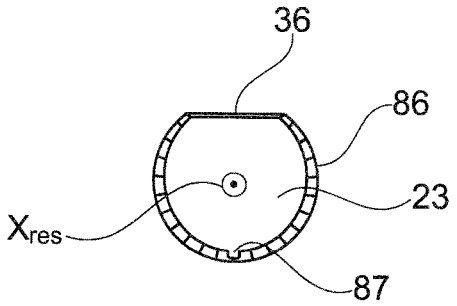
Figure 10:
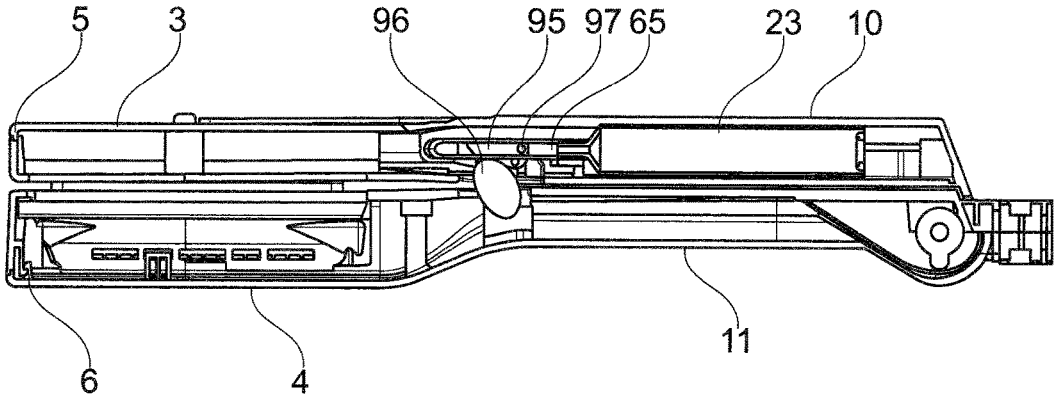
Figure 11:
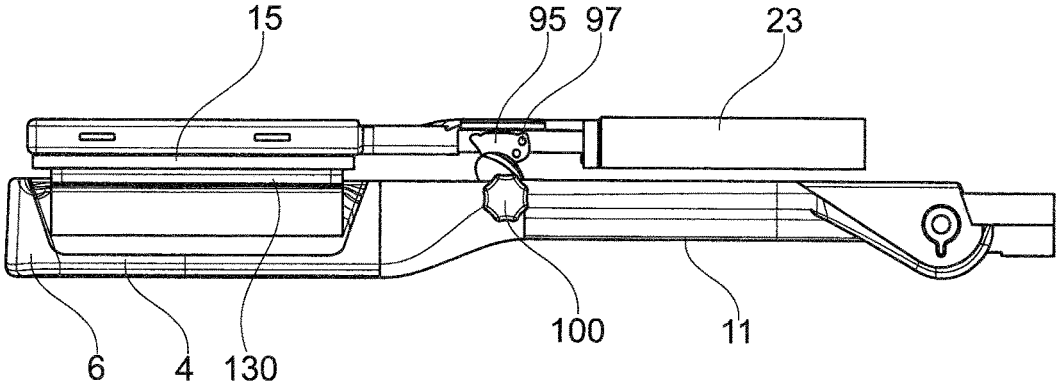
Figure 12:
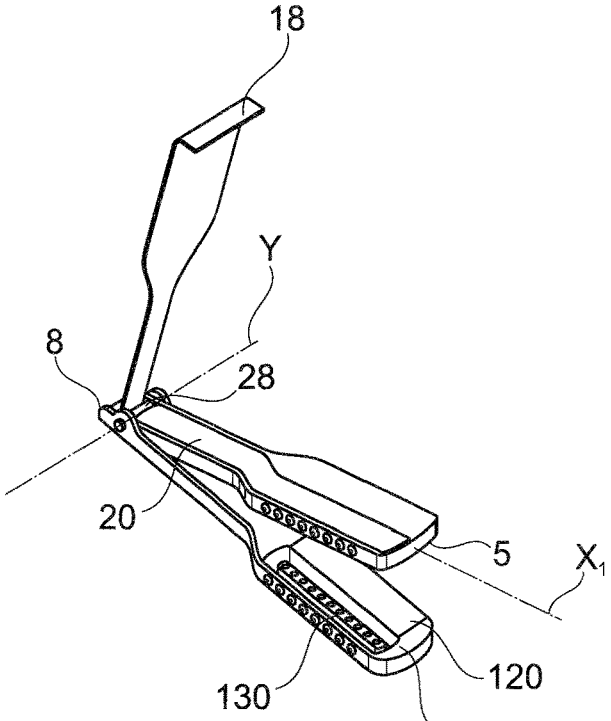
Figure 13:
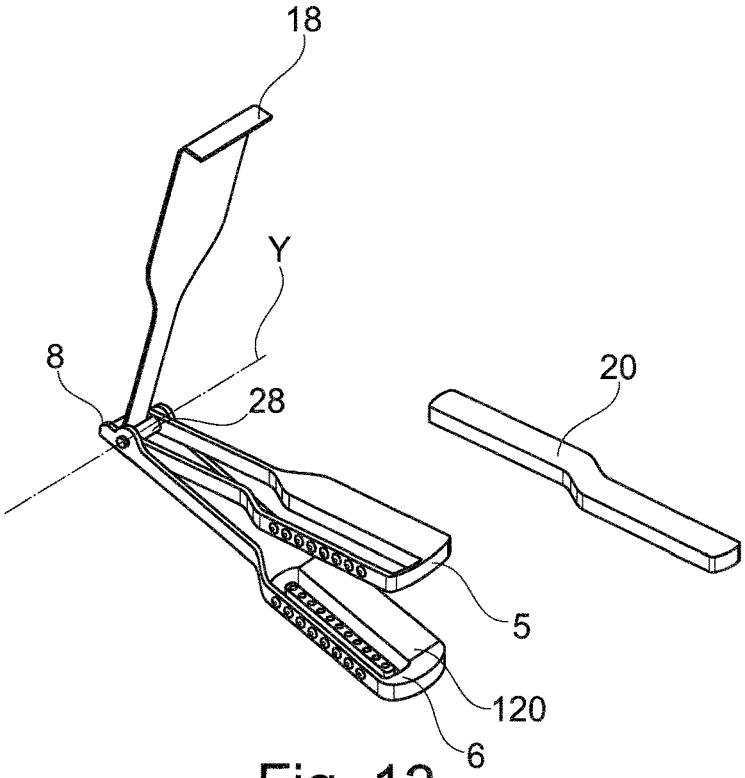
Figure 14:
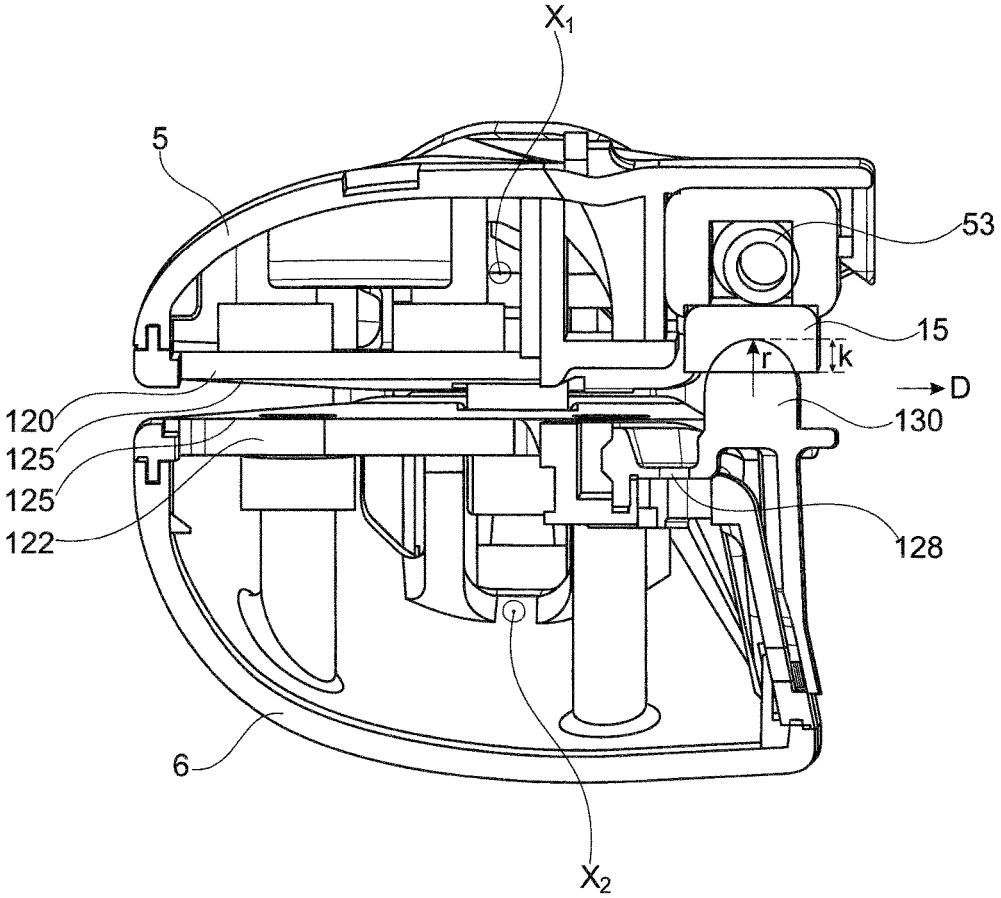
Figure 15:
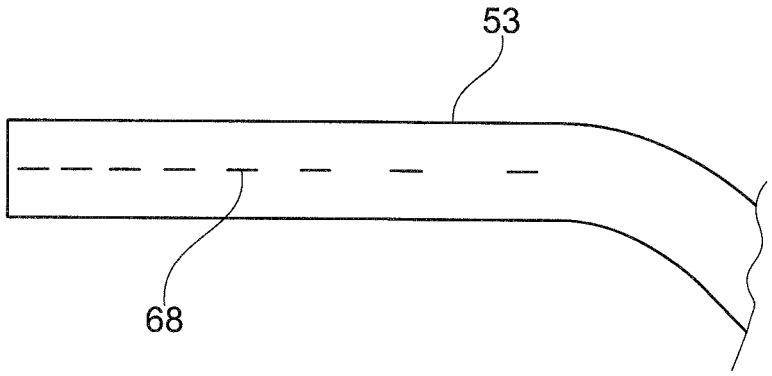
Figure 16:
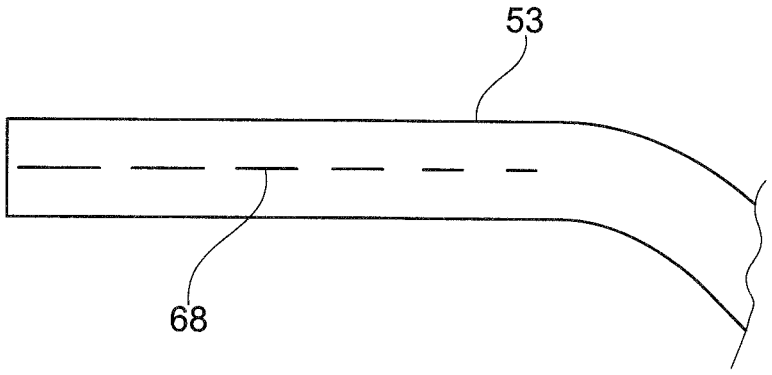

The invention may be better understood from reading the following detailed description of non-limiting implementation examples thereof and from examining the appended drawing, in which:

FIG. 1 schematically shows a perspective view of an example of a device for treating the hair produced in accordance with the invention, with the refill shown above the arm which will receive it, FIG. 2 is a view similar to FIG. 1, the refill being in position on the flap of the device, FIG. 3 is a side view of the device from FIG. 2, FIG. 4 is a front view of the device from FIG. 2 after the flap has been closed, FIG. 5 shows an example of a refill that can be used with the device from FIG. 1, on its own, FIG. 6 shows a side view of the refill from FIG. 5, FIG. 7 is an exploded view of the refill from FIG. 5, FIG. 8A shows a top view of an example of a dispensing end piece, on its own, FIG. 8B is a view similar to FIG. 8A of a variant end piece, FIG. 9 is a cross-sectional view of an example of a refill, FIG. 10 shows a variant device according to the invention in longitudinal section, FIG. 11 shows a side view of a variant device according to the invention, FIG. 12 schematically shows a perspective view of a variant device according to the invention, FIG. 13 shows the device from FIG. 12 before the refill is fitted on the corresponding arm, FIG. 14 is a schematic cross-sectional view of a device according to the invention, illustrating the arrangement of various components thereof, and FIGS. 15 and 16 show variant dispensing end pieces on their own.

FIGS. 1 to 4 show the handpiece 2 of an example of a device for treating the hair according to the invention.

This handpiece 2 has two jaws 3 and 4 that are able to move with respect to one another between a spaced-apart configuration (not shown) for introduction between said jaws of a lock of hair, and a moved-together configuration for treatment.

The jaws 3 and 4 are carried by an upper arm 5 and a lower arm 6, respectively, which, in the example in question, are connected together at one end by an articulation 8, the handpiece 2 thus forming tongs.

The upper arm 5 and lower arm 6 each preferably have a total length of between 22 cm and 31 cm and define, between the articulation 8 and the jaws 3 and 4, respective half-handles 10 and 11 on which the user can press in order to move the jaws 3 and 4 together.

The upper arm 5 and lower arm 6 extend along respective longitudinal axes $X_1$ and $X_2$ which are preferably parallel to one another when the jaws 3 and 4 are closed.

An elastic return member (not visible) is preferably provided to return the jaws 3 and 4 to a spaced-apart configuration, this elastic return member being for example a spring disposed around an articulation pin 8.

The invention is not limited to a particular manner of connecting the upper arm 5 and lower arm 6 together and the jaws 3 and 4 may be rendered able to move in some other way without departing from the scope of the present invention. However, the presence of an articulation is largely preferred for the ergonomics it provides.

The jaws 3 and 4 define between one another a region for treating the hair, said region being intended to receive a lock of hair to be treated, the handpiece 2 being moved along said lock during the treatment, for example in the direction from the root to the end of the hair.

In the example in question, the handpiece 2 is configured to apply a cosmetic product, to treat the hair by way of steam and to carry out a heat treatment of the hair by contact with one or more hot surfaces.

The direction D of movement of the handpiece 2 over the hair, illustrated in FIG. 4, is preferably substantially perpendicular to the longitudinal axes $X_1$ and $X_2$ of the upper arm 5 and lower arm 6.

The handpiece 2 is connected by a line, in the example in question, to a base station (not shown) that is fixed during the treatment and is connected to the mains.

This base station ensures the electric power supply to the handpiece 2 and also its supply with water in order to generate steam, and may also carry out additional functions of processing electrical signals received from the handpiece 2. The line 13 which connects the handpiece 2 to the base station can thus comprise various electrical conductors and a water supply pipe.

A user interface (not shown in the figures) can be present on the handpiece 2 so as to allow the user for example to start up certain components thereof, or not.

The application of the cosmetic product is ensured by an applicator member 15 disposed so as to come into contact with the hair extending through the treatment region.

The applicator member 15 is supplied with product with the aid of a dispensing mechanism which is actuated automatically during the use of the handpiece 2, for example in order to apply a quantity of product to the hair, such that a mass of one gram of hair made up of hair with a length of 20 cm receives between 0.015 and 0.4 g, better still between 0.01 and 0.2 g of product in the case of a care product, or even more in the case of thermal straightening, dyeing or chemical straightening products, the quantity received then being for example between 0.5 and 10 g.

The upper arm 5 may comprise, as illustrated in FIGS. 1 to 4, a pivoting flap 18 which can take up the open configuration illustrated in FIGS. 1, 2 and 3, allowing a refill 20 according to the invention to be fitted and to be removed once the product has been used up, and a closed configuration, shown in FIG. 4, for using the device to treat the hair.

The refill 20 comprises a reservoir 23 containing the product to be applied and a head 25 comprising the applicator member 15.

In the example illustrated, the pivoting flap 18 is articulated about a rotation axis Y which is oriented substantially parallel to the longitudinal axis $X_1$ of the upper arm 5.

The flap 18 is for example articulated by way of a hinge 28, as illustrated in FIG. 1, to the proximal part of the arm 5 which acts as a half-handle 10 while the handpiece 2 is being used.

In the example illustrated, the proximal part 18*a* of the flap 18 also defines a gripping surface of the half-handle 10.

The flap 18 can be articulated so as to open towards the rear when the device is viewed as in FIG. 1. This can make it easier to produce the hinge 28 and construct the device so as to provide access that is as open as possible to the user to allow him to fit or replace the refill 20.

The angular travel $\alpha$ of the flap 18 is advantageously at least 90° so as to make it easier to introduce the refill 20 into the handpiece 2 during the fitting or replacement thereof.

The closing or opening movement of the flap 18 may, if appropriate, be assisted by an elastic return member, for example a helical spring or leaf spring disposed in the region of the hinge 28. This return member can urge the flap 18 towards its open position, collecting elastic potential energy when the flap 18 is closed. The use of such a return member, the opening of which is assisted, is particularly advantageous when the device is also equipped with a member for locking the flap 18 in the closed position. In this case, when the user acts on this locking member in order to unlock this flap 18, the flap 18 can be opened automatically, advantageously as far as its completely open position or, in a variant, over only a part of the opening travel.

It is possible to provide the flap 18 with a movement retarder when the hinge 28 is equipped with an elastic return member which tends to urge the flap 18 towards the open or closed position.

The flap 18 can be held in the closed position on the upper arm 5 in various ways, and preferably with snap-fastening of at least one relief carried by the flap 18 onto a corresponding form (not illustrated) carried by the base of the arm 5. For example, as illustrated, the flap 18 carries at least one elastically deformable tab 31 which can be snap-fastened onto a corresponding coupling relief provided on the base of the arm 5. If appropriate, a means for locking/unlocking by the user is provided to keep the flap 18 in the closed position. In this case, the user has to exert an action on this unlocking means before opening the flap 18. This can reduce the risk of the flap 18 opening accidentally if the handpiece 2 is dropped, for example.

The flap 18 may have any suitable form for at least partially covering the refill 20 once the latter is fitted in the device, in particular when the head 25 and the reservoir 23 are not aligned.

The flap 18 may have a configuration in which the distal part 18*b* of the flap 18, said distal part 18*b* being located in the region of the jaw 3, is offset upwards with respect to the proximal part 18*a* of the flap 18 which serves to articulate it on the base of the upper arm 5, when the flap 18 is viewed in a position which is open more or less at 90°, as can be seen in FIG. 1, to the articulation pin of the horizontal arms. The flap 18 can thus comprise an intermediate portion 18*c* which extends generally obliquely upwards and towards the front.

In a variant, the flap 18 may be coupled in some other way to the base of the arm 5 and for example be articulated by way of its distal part 18*b* in the region of the jaw 3.

The flap 18 may comprise reliefs 80 which allow the refill 20 to be fastened thereto while the flap 18 is in the open position.

In the example in question, the flap 18 is articulated by way of its proximal part 18*a*, but may also be articulated in some other way.

In a variant, the refill 20 may be carried by the arm 5, the flap 18 covering the refill 20 in the closed position.

The flap 18 may be made of an opaque material with at least one transparent window (not illustrated) that allows the user to see that the refill 20 is present and/or to see the level of product in the reservoir 23 if the refill 20 is provided for this purpose.

As illustrated in FIG. 4, the housing 33 may comprise at least one opening 36 facing the lower arm 6 so as to allow the haircare product contained in the reservoir 23 to be applied to a lock of hair. This opening 36 receives the applicator member 15 during the introduction of the refill 20 into the housing 33, and has a corresponding elongate shape.

The refill 20 may have various configurations and for example, as illustrated, the reservoir 23 may be located on the proximal side of the handpiece 2, in particular in the region of the half-handle 10, and the head 24 may be positioned in the region of the jaw 3.

It is advantageous for the reservoir 23 to be housed in the half-handle 10, as illustrated in FIGS. 1 to 4, so as in particular to make it possible to reduce the inertia of the handpiece 2 as the articulation pin 8 of the upper arm 5 and lower arm 6 approaches the centre of mass of the mass of product contained in the reservoir 23. Less inertia makes the handpiece easier to handle and less tiring for the user to carry.

The handpiece 2 may be designed to automatically detect the presence of the refill 20 in its housing 33.

This detection may be carried out for example electronically, by virtue of a contactor actuated by the refill 20 when the latter is fitted on the handpiece 2. This contactor is for example carried by the base of the upper arm 5 and actuated by the reservoir 23. In a variant, the presence of the refill 20 on the base of the upper arm 5 may be detected by virtue of the flap 18, for example on account of the presence on the flap 18 of a contactor, the state of which changes depending on whether the refill 20 is present or not.

The closure of the flap 18 may itself be detected automatically such that, for example, the operation of the handpiece 2 is only allowed once it has been verified that the flap 18 is in the closed position.

When the flap 18 is in the closed position, communication may remain between the inside of the housing 33 that receives the refill 20 and the outside, allowing the user to see that the refill 20 is present on the device.

The refill 20 may optionally be produced so as to have an extension which remains visible from the outside of the device once the flap 18 has been closed, the user being able to know, by seeing this extension, that the refill is present in the device without opening the flap 18.

In a variant that is not illustrated, the flap 18 carries a member (not shown) for closing off the applicator member 15 when the handpiece 2 is not in use, making it possible in particular to use the latter without product being applied.

The refill 20 may be inserted between reliefs 36 on the flap 18 which position it.

A refill 20 that can be used on the handpiece 2 in FIGS. 1 to 4 is shown more particularly in FIGS. 5 to 7.

This refill 20 comprises an integral support 83 which defines a housing that receives the dispensing end piece 53, and which serves to hold the applicator member 15 on the dispensing end piece 53.

In the example in question and as can be seen in particular in FIG. 5, the reservoir 23 and the head 25 extend along respective longitudinal axes $X_{res}$ and $X_{em}$ which are parallel to one another and offset with respect to one another by a distance c of for example between 24 and 32 mm. The support 83 preferably comprises an angled part 83*a*. The longitudinal axes $X_{res}$ and $X_{em}$ can extend in a plane M which is parallel to the plane of the upper face of the thermoformed support shell 39, defined by a peripheral rim 60, but preferably the longitudinal axes $X_{res}$ and $X_{em}$ are located at different distances from this plane.

In the example illustrated in FIG. 7, the support 83 extends along a distance l which is less than the total length $L_{rech}$ of the refill 20.

The reservoir 23 preferably comprises a rigid body 86.

The support 83 may comprise an extension 88, illustrated in FIG. 6, which serves to keep the reservoir 23 in a predefined position relative to the dispensing end piece 53.

At its end, the extension 88 has an end piece, in particular having an annular shape, which is produced by moulding in one piece with the rest of the support 83, into which the body 86 of the reservoir 23 is inserted. The end piece 92 for connecting to the duct 65 may be produced in one piece by being moulded with the body 86 of the reservoir 23.

A duct 65, which is preferably flexible, connects the reservoir 23 to the dispensing end piece 53 and extends through the extension 88. The duct 65 and the reservoir 23 can be connected by the end piece 92.

The dispensing end piece 53 can extend along the longitudinal axis Z of the refill 20.

The dispensing end piece 53 is preferably designed to deliver the product in one direction through at least one dispensing orifice 68 that is visible in FIGS. 8A and 8B, is closed at rest and can open under the pressure of the upstream product.

As illustrated in FIGS. 8A and 8B, the dispensing end piece 53 may comprise a number of dispensing orifices 68 disposed in line with one another so as to deliver the product along the applicator member 15.

This or these dispensing orifice(s) 68 may be slots that are elongate along an axis perpendicular, as illustrated in FIG. 8A, to the longitudinal axis $X_{em}$ of the dispensing end piece 53. In a variant, the orifices 68 are oriented along an axis parallel to the longitudinal axis of the dispensing end piece 53. The centre(s) of mass of the dispensing orifice(s) 68 is/are preferably aligned along a diametric median plane of the dispensing end piece 53. The length p of each dispensing orifice 68 may range from 1 to 5 mm. The dispensing orifices 68 may have identical lengths p and be distributed evenly along the dispensing end piece 53. The interval w between two consecutive dispensing orifices 68 is for example from 1 to 5 mm.

Preferably, the dispensing end piece 53 is elastically deformable such that the internal volume can be increased in order to collect product coming from the reservoir 23 before it is dispensed, and the dispensing orifice(s) 68 is/are designed to only open following such an increase in volume. Thus, it is possible to spread out the dispensing of product over a period of time greater than that for which the action of filling the dispensing end piece 53 lasts.

Prolonged dispensing of the product is useful in order to ensure application that is as homogeneous as possible right along the treated lock and to reduce the risk of product being present in a quantity that is not suitable.

Preferably, the system for supplying the applicator member is designed such that the dispensing of the product after the jaws 3 and 4 have been moved together lasts more than 10 s, in particular between 10 and 30 s, for example around 20 s, i.e. more or less the average duration of treatment of a lock for most users.

A particularly simple and effective way of obtaining prolonged dispensing of the product is to use an elastomeric material to produce the dispensing end piece 53, with a tubular shape closed at one end, and for example having a hardness of Shore 55, and to provide it, as illustrated in FIGS. 8A and 8B, with a number of dispensing orifices 68 in the form of slots that are closed at rest and are capable of opening by elastic deformation under the pressure of the upstream product. The slots are preferably produced by cutting, so as to close with proper sealing at rest.

The dispensing end piece 53 comprises for example a tubular body with a wall thickness of between 0.3 and 2 mm, for example with an inside diameter of 3.2 mm and an outside diameter of 5 mm, and made of silicone or some other material such as EPDM (rubber).

The dispensing end piece 53 may be at least partially defined by the duct 65.

Preferably, the applicator member 15 comes into contact with the dispensing end piece 53 next to the orifices 68 so as to absorb the product delivered thereby as soon as it exits.

The applicator member 15 can be fastened to the support 83 in various ways. The applicator member 15 may for example be retained on the support 83 by friction or in a variant be retained by adhesive bonding or welding or with the aid of an additional holding element (not illustrated). In particular, the applicator member 15 may be wedged in an opening 60 of elongate shape that is made in the support 83.

The applicator member 15 may be held in a removable or non-removable manner on the support 83. It is advantageous to be able to change the applicator member 15 from one use to another without having to replace the refill 20 as a whole, in particular for reasons of hygiene or in order for it to be possible to place the applicator member 15 in a closed container between two uses so as to avoid drying out thereof.

In a variant, the refill 20 may be provided with a removable closure member (not illustrated) to be fitted on the applicator member 15 when not in use. This closure member may be designed to be fitted on the applicator member 15 before or after the introduction of the refill 20 into the handpiece 2, consisting for example of a cap designed to be fastened hermetically to the handpiece 2 or the refill 20.

In a variant, the closure member is a membrane seal to be removed when the handpiece 2 is used for the first time or when the refill 20 is fitted into the handpiece 2.

The support 83 is preferably designed to be fastened to the flap 18 by cooperation of shapes, in particular by snap-fastening. For example, in the region of its distal part 18*b*, which is located on the jaw 3, said flap 18 comprises tabs 80 which are snap-fastened to the support 83. The proximal part 18*a* of the flap 18 may also comprise reliefs 36 which hold the reservoir 23 by friction and/or snap-fastening.

The reservoir 23 preferably comprises a rigid body 86 in which a follower piston 90, illustrated in FIG. 6, can move.

In a variant that is illustrated in FIG. 9, the reservoir 23 is at least partially rigid or flexible. The reservoir 23 may comprise a rigid body 86 and an elastically deformable wall 36 which is fastened to the rigid body 86 and which may progressively mould itself to the shape of the bottom of the housing 47 as the reservoir empties. The rigid body 86 may, if appropriate, comprise at least one longitudinal groove 87 that facilitates the discharging of the product when the wall 36 tends to mould itself to the shape of the bottom of the housing 47.

The follower piston 90 may be produced with a non-return washer 94 which can slide over the internal surface of the body 86 when the internal volume of the reservoir 23 decreases and can become braced in order to prevent any reverse movement of the piston 90.

Filling of the dispensing end piece 53 under pressure can be carried out in various ways.

In the variant in FIGS. 1 to 4, the product is moved from the reservoir 23 to the dispensing end piece 53 by the actuation of a peristaltic pump.

A particularly simple and effective way of producing this pump is to use a system as illustrated in FIG. 10, comprising a pressing element 95 such as a roller or a cam which is able to move on the upper arm 5 so as to be able to bear, during its movement, against the flexible duct 65 connecting the reservoir 23 to the head 25 and to pinch it, and then to progressively squeeze it in the direction of the head 25 in order to flush the product contained inside towards the head 25. The duct 65 remains pinched as long as the jaws 3 and 4 are closed over the hair, this making it possible to keep the dispensing end piece 53 under pressure and to force the product to leave it through the orifices 68.

As illustrated in FIGS. 10 and 11, the pressing element 95 can be actuated by a relief 96 carried by the lower arm 6, this relief 96 coming into contact with the pressing element 95 when the jaws 3 and 4 are moved together.

On its opposing faces, the pressing element 95 may comprise two pairs of lugs 97 that are inserted into guide slots 99, visible in FIGS. 1 and 2, that are provided on uprights 98. These slots 99 are oriented substantially perpendicularly to the axis of the flexible duct 65 extending between the uprights 98. The pressing element 95 can move first of all substantially in translation, in the slots 99, in order to pinch the flexible duct 65, under the pushing pressure of said relief 96. The slots 99 each have a notch which allows the pressing element 95 then to tilt, progressively squeezing the flexible duct 65, the lugs 97 engaging in the notches as the pressure by the relief on the pressing element 95 continues.

Preferably, as illustrated in FIG. 11, the relief 96 is carried by an adjusting member 100, such as a slider or a knob, the rotation or movement of which acts on the degree of protrusion and/or the position of the relief which acts on the pressing element 95. In a variant, the flow rate is adjusted at the arm which carries the reservoir, by virtue for example of an adjusting member which restricts the flow of the product to a greater or lesser extent or which pushes back, to a greater or lesser extent, a counter-bearing surface against which the flexible duct 65 is compressed by the pressing element 95 during the operation of the peristaltic pump.

The adjusting member 100 can make it possible to adjust the pressing element 95 into an extreme position for operation of the device without cosmetic product being dispensed. By virtue of the adjusting member 100, the user benefits from the possibility of acting on the flow rate of cosmetic product delivered on each closure of the jaws 3 and 4. The adjustment can be carried out continuously or incrementally, depending on the manner in which the adjusting member 100 is able to move on the lower arm 6.

In a variant that is not illustrated, the refill comprises a flap-valve pump and the handpiece is produced so as to actuate this flap-valve pump for example when the two arms have been moved together or, in a variant, with the aid of an actuating member which can be actuated by the user independently of the moving together of the arms. The flap-valve pump is disposed in the place of the flexible duct connecting the dispensing end piece to the reservoir. The flap-valve pump may comprise a diaphragm which, when the flap is closed, is positioned opposite an actuating member which is, for example, height-adjustable so as to be able to control the quantity of product delivered by the pump on each actuation. The flap-valve pump comprises a body which is made in one piece with end pieces which serve to connect to the reservoir and to the dispensing end piece, respectively. The flap-valve pump comprises a pumping chamber partially delimited by the diaphragm. The end piece for connecting to the reservoir may house an inlet valve which opens when the volume of the pumping chamber increases and which closes again when this volume decreases during the actuation of the diaphragm. The pump may also comprise an outlet valve which can be integrated into the pump, being for example located in the region of the end piece for connecting to the duct. An anti-backflow valve may be present between the reservoir and the pumping chamber, opening in the direction of flow from the reservoir to the pumping chamber.

In a variant, the outlet valve is formed by the dispensing orifice(s) of the dispensing end piece, which open under the effect of the pressure of product upstream and close again when the pressure has decreased, by virtue of the inherent elasticity of the material of which the duct is made.

When the diaphragm is deformed by bearing on the actuating relief on the lower arm, the internal volume of the pumping chamber decreases. The inlet valve is closed and the product is flushed towards the dispensing end piece. The outlet orifice(s) may open under the effect of the pressure of the product and then close again when the pressure decreases following the discharging of the product.

When the actuating relief moves away from the diaphragm, the latter returns to its initial shape by inherent elasticity, resulting in the increase in volume of the pumping chamber, which returns to its initial volume. The corresponding reduction in pressure causes the inlet valve to open and product coming from the reservoir to be admitted.

In a further variant, the system for dispensing product may be realized without a pump with the aid of a follower piston that moves unidirectionally in the reservoir, this movement being brought about by the moving together of the jaws 3 and 4. For example, the piston is pushed by a rod which is driven incrementally and unidirectionally in movement each time the jaws are moved together.

The supply system may be realized so as to cause a dose of product to be dispensed only after the jaws have been moved together a predefined number of times. The flap 18 may be articulated about a longitudinal axis Y which is generally parallel to the longitudinal axis $X_1$ of the upper arm 5 or, in a variant, as illustrated in FIGS. 12 and 13, about an axis Y which is transverse to the longitudinal axis $X_1$ of the upper arm 5 and for example an axis which is parallel to, better still coincident with, the pin for articulating the lower arm 6 and upper arm 5 together. It may be advantageous for the articulation of the pivoting flap to be the same as that of the arms, since this can make it easier to manufacture the handpiece 2.

However, it is preferable to produce the flap 18 such that it is articulated about an axis substantially parallel to the longitudinal axis $X_1$ of the arm 5, since this can reduce the span length and thus reduce the need to stiffen the flap 18.

The flap 18 may be articulated about a fixed rotation axis or, in a variant, the movement of the articulation may be more complex and in particular may take place by virtue of a hinge 28 that allows not only a purely rotational movement but also a movement in translation so as to ensure for example the parallelism of the surfaces which come into contact with the flap 18 and with the base of the arm 5 which carries the latter. In that case, the hinge 28 has for example bearings with somewhat oblong holes, in which the articulation pin can move, optionally with the presence of an elastic return member which tends to urge this pin into abutment against one end of the oblong housings.

A window may be provided, if appropriate, so as to allow the user to see the degree of emptying of the reservoir 23. In a variant, each action of moving the jaws 3 and 4 together increments a counter which is initialized on the installation of a new refill 20, this counter being able to be used to warn the user that complete emptying of the reservoir 23 is imminent. The counter may also be used to signal to the user that the product is ready to be dispensed, when a particular number of actuations of the jaws 3 and 4 is necessary before the product impregnates the applicator member 15, given the dead volume which it is necessary to start filling before the product is dispensed. When the moving together of the jaws 3 and 4 is detected electrically, counting can be effected electronically by the base station.

In a further variant, the system for supplying the applicator member 15 with product is driven in a motorized manner by virtue of an electric motor housed in the arm 5, or possibly in the assembly that forms a refill 20.

If appropriate, the refill 20 may comprise an identifier recognized by the device, this allowing at least one of the following additional functions:

- automated adjustment of one or more operating parameters of the device depending on the knowledge of the nature of the product by the base station, which follows from the recognition of the identifier,
- display of information that guides the user in operations to be carried out depending on the nature of the product contained in the refill 20,
- knowledge of the capacity of the reservoir 23 fitted and the output of a signal warning the user when the product has been used up, assuming that the device knows the number of doses dispensed, for example by counting the number of times that the jaws 3 and 4 have been moved together,
- passage into a predefined state of the device if the presence of the reservoir 23 is not detected, for example output of a warning signal,
- preventing operation in the event of non-recognition of an identifier having an authentication function.

The refill 20 can be identified mechanically and/or electronically. In the latter case, the refill 20 may carry an electronic chip in which the useful information is contained and one of the arms 5 or 6 may carry corresponding reading means.

In the examples illustrated, the heat treatment is ensured by two heating elements 120 and 122, visible in FIG. 14, that are carried by the upper arm 5 and lower arm 6, respectively, each having a plate that defines a hot surface 125 for bringing into contact with the hair.

The plates of the heating elements 120 and 122 are made of any material suitable for the treatment to be carried out, for example a metal, ceramic or glass.

The surface state of the plates of the heating elements 120 and 122, in the region of contact with the hair, depends on the desired treatment, and preferably the plates are smooth when the device is intended to straighten the hair.

The length of the plates defines the extent of the treatment region perpendicularly to the direction D of movement of the handpiece 2 relative to the hair. The hot surfaces 125 defined by the plates are for example flat and have a rectangular contour.

One of the plates is for example mounted in a fixed manner on the corresponding arm while the other is mounted in an articulated manner, for example with the aid of a ball joint, so as to allow the plates to extend parallel to one another and to a median treatment plane in the closed configuration of the jaws. If appropriate, at least one of the plates is disposed on one of the arms 5 and 6, being supported by a structure that forms a spring.

The heating elements 120 and 122 may each comprise an electrical resistor electrically powered by the base station, preferably with temperature regulation by virtue of one or more sensors disposed in the vicinity of the heating resistors or in contact with the plates.

Treatment with steam is ensured by virtue of a vaporization member consisting of a resistive element provided in an evaporation chamber supplied with water by the base station. The latter may comprise an electrically driven pump, preferably a peristaltic pump, that draws up water to be sent to the handpiece 2 from a reservoir of water. The pump is for example as disclosed in the publication FR 2 967 018.

The evaporation chamber may be produced in accordance with the teaching in the application EP 2449909A1 or otherwise, and communicate with at least one steam outlet.

The evaporation chamber is disposed on one of the arms, namely the lower arm 6 in the example in question, and the steam outlet is provided on the same arm 6.

In the example illustrated, the steam outlet is in the form of a ramp 128 with a shape that is elongate in a direction parallel to the longitudinal axis $X_2$ of the lower arm 6.

The ramp 128 may have a number of orifices for spraying steam, for example between 6 and 10 orifices, which are preferably distributed evenly along the ramp 128 and each have an axis oriented substantially perpendicularly to the median treatment plane.

The vaporization member is electrically powered by the base station and a temperature sensor is advantageously disposed in the evaporation chamber. The base station may be produced so as to control the electric power supply of the vaporization member in order to keep the temperature of the steam leaving the evaporation chamber at a value of between 110° C. and 130° C.

Preferably, as illustrated in FIG. 14, the applicator member 15 is disposed opposite a counter-bearing surface 130 defined by a block carried by the lower arm 6. This counter-bearing surface 130 is preferably substantially in the form of a half cylinder of revolution, with a generatrix parallel to the longitudinal axis $X_2$ of the lower arm 6. In a variant, the counter-bearing surface 130 may be a roller.

The counter-bearing surface 130 may help to channel the steam exiting the ramp 128 towards the hair.

When the jaws 3 and 4 are closed, the counter-bearing surface 130 comes into abutment against the applicator member 15 and preferably the counter-bearing surface 130 slightly compresses the applicator member 15, for example over a distance k of between 1 and 5 mm.

The radius of curvature r of the counter-bearing surface 130, measured about an axis parallel to the longitudinal axis of the arm, is for example between 2 and 10 mm.

The counter-bearing surface 130 may be able to move relative to the jaw 4 which carries it, and its movement may be controlled by an adjusting member, for example the one that adjusts the quantity of product dispensed while the arms 5 and 6 are moved together. Preferably, this adjusting member acts on the height of the counter-bearing surface 130. When the adjusting member is in a position not actuating the pump, the counter-bearing surface can reach its maximum height and thus be in a position of maximum compression of the applicator member 15. This configuration can make it possible to wipe the applicator member after use.

The counter-bearing surface 130 may also be defined by a member designed to define a protective cap for the applicator member 15 when not in use. This member can thus cover the applicator member 15 partially, and preferably entirely, in order to promote the preservation of the product still impregnating the applicator member 15.

The handpiece 2 may comprise a comb (not shown) which is preferably fastened removably to the lower arm 6. This comb is produced for example from a rigid thermoplastic material and has a shape that is elongate along the longitudinal axis $X_2$ of the lower arm 6.

The presence of the comb is advantageous in that it divides the lock into bundles, this tending to increase the contact surface of the hair with the hot surfaces 125 and to improve the straightening action. In addition, by dividing the lock, the surface area for exchange with the steam and the cosmetic product is also increased, to the benefit of the effectiveness of the treatment. The comb can also help to increase the traction exerted on the hair, and this can improve the shaping thereof, in particular in the case of straightening. The comb can also help to homogenize the product deposited upstream on the hair by the applicator member 15.

Preferably, the device is produced such that a portion of hair introduced between the jaws 3 and 4, and moving relative thereto when the handpiece 2 is drawn from the root of the hair to the end thereof in the direction D, is successively subjected to exposure to the cosmetic product, by passing between the applicator member 15 and the counter-bearing surface 130, to the steam by passing in line with the ramp 128 for spraying steam, and to a heat treatment by passing between the hot surfaces 125.

The handpiece 2 may advantageously have on its top a marker, visible to the user, such as an arrow, informing said user of the correct direction of movement of the device.

The steam treatment can improve the penetration of the product deposited upstream on the hair. The heat treatment makes it possible to dry the hair and to fix its shape.

Numerous modifications can be made to the device that has just been described, without departing from the scope of the present invention.

In a variant that is not illustrated, the heating elements 120 and 122 and the associated hot surfaces 125 are absent, the device being designed to only effect the application of the cosmetic product and the exposure to the steam, for example in the context of haircare or a dyeing treatment.

There may be multiple heating elements 120 and 122 on each of the arms 5 and 6, this being able to allow the handpiece 2 to be used in any direction of movement on the hair, if appropriate. The device may also retain a preferred direction of movement D during the treatment, even when there are multiple heating elements 120 and 122 on each of the arms 5 or 6.

The heating elements 120 and 122 carried by one and the same arm 5 or 6 may comprise plates with an identical width and operate simultaneously.

In order to obtain a symmetrical treatment regardless of the direction of movement, the device may comprise two steam outlets on either side of the member 15 for applying cosmetic product and between the hot surfaces 120 and 122.

If there are multiple heating elements 120 and 122 on each of the arms 5 and 6, the member 15 for applying cosmetic product may be disposed away from the heating elements 120 and 122, only one steam outlet being present between the plates.

The movement over the hair is preferably carried out so as to ensure that the cosmetic product is deposited first.

In a variant that is not illustrated, at least one of the heating elements 120 and 122 is produced so as to be able to rotate in contact with the hair when the handpiece 2 is moved along the lock to be treated, and is in the form for example of a rotary cylinder. The other heating element 120 and 122 may have a concave curved shape, suitable for accommodating the roller when the jaws 3 and 4 are moved together.

The steam spraying direction may be non-perpendicular to the median treatment plane, in order to increase the area impacted by the jet of steam, with an inclination of 0 to 20° with respect to the normal, for example. The jet exiting each outlet orifice of the ramp (also known as a nozzle) may be sufficiently divergent to result in substantially uniform exposure of the lock in the direction of its width.

The device according to the invention is preferably used with a base station; in a variant, the handpiece 2 is autonomous, comprising the reserve of water necessary for producing steam.

The cosmetic product applied by the device according to the invention may be any type of haircare product. The expression cosmetic haircare product denotes a composition comprising one or more active ingredients for haircare use, and in particular a product as defined in directive 93/35/EEC dated 14 Jun. 1993. Water in liquid or gaseous form which does not contain any additives for haircare use does not constitute a cosmetic product within the meaning of the present invention. The cosmetic product may be intended to make it easier to shape the hair. Examples of active ingredients are given for example in the publication US 2010/0307528 A1, in paragraphs [0031] and [0032]. The product may have an aqueous or non-aqueous base.

In the examples which have just been described, the cosmetic product is not heated other than by heat losses due to the presence of the heating elements 120 and 122 and the spraying of steam between the jaws 3 and 4. In one variant, the cosmetic product is heated by a specific heating means so as to raise the temperature thereof prior to application, for example a heating resistor printed onto a sleeve through which the product passes or which is disposed on the reservoir or in contact therewith. This increase in temperature may have the effect of decreasing its viscosity and making it easier to apply.

The applicator member 15 may be produced in some other way than with a foam, for example with a felt, a frit or a brush.

The refill 20 may comprise at least one closure member that can be positioned in a removable manner on the applicator head 25, in particular on the applicator member 15, in order to protect the latter from the outside environment when not in use for applying the product. The closure member may be able to be applied to the refill 20 when the latter is or is not on the handpiece 2. When the refill 20 is positioned in the housing 33 of the handpiece 2, the closure member may cover the applicator member 15. The closure member may be separable from the device or, in a variant, be an element that is permanently present on the device. The member defining the counter-bearing surface 130 may be removable and serve, in particular when turned round, as a member for closing the refill 20.

On account of the longitudinal configuration of the refill 20, the dispensing of product through evenly distributed dispensing orifices 68 of constant size is not uniform. The dispensing orifices in the vicinity of the reservoir are subjected to a greater pressure than those located at the end and, as a result, open more and dispense more product towards the applicator member 15. The following variants make it possible to make the dispensing of the product towards the applicator member 15 along the dispensing end piece 53 more uniform.

The dispensing orifices 68 of the dispensing end piece 53 are, in a variant as illustrated in FIG. 15, spaced apart at a variable distance w, the density of dispensing orifices 68 then varying with their position on the dispensing end piece 53. Preferably, the density of dispensing orifices 68 increases with increasing distance from the reservoir 23 so as to allow product to be dispensed uniformly in the direction of the applicator member 15.

The dispensing orifices 68 of the dispensing end piece 53 have, in a variant as illustrated in FIG. 16, a variable width p depending on their position on the dispensing end piece 53. Preferably, the width p of the dispensing orifices increases with increasing distance from the reservoir 23 so as to allow product to be dispensed uniformly in the direction of the applicator member 15.

The counter-bearing surface 130 is, in a variant, inclined obliquely with respect to the applicator member 15 so as to exert a variable pressure on the applicator member 15. Preferably, the pressure exerted on the applicator member 15 by the counter-bearing surface 130 increases with increasing distance from the reservoir 23 so as to allow product to be applied uniformly to the lock of hair introduced between the upper arm 5 and lower arm 6.

The device can be used by moving the jaws 3 and 4 along a lock in order to straighten the hair. The device can also be used by winding the lock around a jaw 3 or 4 and unwinding it by sliding it over this jaw 3 or 4 in order to curl the hair.

The device can be used in the hot state without steam production or without the heating elements 120 or 122 being activated.

In one variant, the steam outlet and the applicator member 15 occupy substantially the same position relative to the direction of movement D of the device over the lock of hair. In this case, the steam outlet orifice(s) is/are formed for example through a counter-bearing surface against which the applicator member 15 bears when the jaws 3 and 4 are closed.

In the examples illustrated, the generation of steam takes place on the lower arm 6 and the application of product on the upper arm 5. This arrangement can be reversed.

It is possible for the dispensing end piece 53 not to be elastically deformable and the product may be dispensed only during the moving-together movement of the jaws 3 and 4. An elastically deformable chamber for collecting the product may also be interposed in the path of the product between the duct 65 against which the pressing element 95 and the dispensing end piece 53 bear, this chamber being formed for example by a portion of elastically deformable tube or by a diaphragm that is elastically deformable or able to move without inherent elasticity but comes into abutment against an elastic return member which deforms in order to accompany the increase in volume and which generates the pressure necessary to continue dispensing the product once the jaws 3 and 4 have been moved together.

The housing in the device that receives the refill may comprise at least one light source.

This source may allow the user to see that the refill is present while the device is in operation.

When the refill is made at least partially of a material that makes it possible to see the cosmetic product contained in the interior thereof, the light source can make it easier for the user to determine the level of cosmetic product remaining in the refill.

Thus, it may prove to be advantageous to produce the refill with at least a portion of the reservoir made of a transparent or translucent material, and to dispose the light source so as to light the reservoir.

Preferably, the flap has a window which makes it possible to see at least a lit part of the reservoir, such that the user can know the level of product remaining while the flap is in the closed position. If appropriate, the colour of the light source can change depending on certain parameters, for example in order to signal that the treatment temperature has been reached or that the level of product or of water is low.

The expression "comprising a" should be understood as being synonymous with "comprising at least one", and the limits are included in all the ranges of values indicated.

The invention claimed is:

1. Refill for an appliance for treating hair, comprising:

a reservoir configured to contain a haircare product and comprising a rigid or semi-rigid body configured to be in contact with the product, a dispensing end piece configured to dispense the product contained in the reservoir, a fluidic connection disposed between the dispensing end piece and the reservoir, an applicator member configured to: (i) receive the product from the dispensing end piece, and (ii) apply the product to the hair, and a support that supports the dispensing end piece, the fluidic connection, and at least a part of the reservoir, the support being produced in an integral manner, the refill extending along a longitudinal axis, a length of the support, measured along said longitudinal axis, being less than a total length of the refill.

2. The refill according to claim 1, wherein the reservoir extends along a longitudinal axis and has a single outlet for the product at one end.

3. The refill according to claim 1, wherein a length of the reservoir is less than half the total length of the refill, measured along said longitudinal axis.

4. The refill according to claim 1, wherein the internal volume of the reservoir is configured to vary while the refill is being used.

5. The refill according to claim 1, wherein the dispensing end piece has at least one dispensing orifice.

6. The refill according to claim 1, wherein the dispensing end piece is connected to the reservoir by a flexible duct.

7. The refill according to claim 1, wherein the dispensing end piece is pre-filled with the product.

8. The refill according to claim 1, wherein the dispensing end piece and the reservoir have respective longitudinal axes that are not coincident.

9. The refill according to claim 1, wherein the maximum capacity of the reservoir is between 2 ml and 20 ml.

10. The refill according to claim 1, wherein the rigid or semi-rigid body of the reservoir has a tubular shape.

11. The refill according to claim 1, wherein the reservoir comprises a follower piston.

12. The refill according to claim 11, wherein the follower piston is configured to move unidirectionally by virtue of the presence of an anti-recoil system.

13. The refill according to claim 1, wherein the reservoir extends along a longitudinal axis and comprises a flexible wall.

14. The refill according to claim 1, wherein the applicator member at least partially covers the dispensing end piece.

15. The refill according to claim 1, wherein the applicator member comprises a porous material and/or a material that is able to release or diffuse the product.

16. The refill according to claim 1, wherein the dispensing end piece is carried by a support rigidly connected to the reservoir.

17. The refill according to claim 16, wherein the rigid or semi-rigid body of the reservoir and the support are produced in an integral manner.

18. The refill according to claim 1, wherein the applicator member is held on the support by a holding element fixed to the support.

19. The refill according to claim 18, wherein the applicator member is configured to be removable from the support.

20. The refill according to claim 1, further comprising one or more components of a pump for supplying the dispensing end piece with the product present in the reservoir.

21. The refill according to claim 20, wherein the components of a pump is at least one peristaltic pump tube and/or a flap-valve pump.

22. The refill according to claim 21, wherein the dispensing end piece is connected to the reservoir by a flexible duct, and the peristaltic pump tube is formed by a portion of said flexible duct.

23. The refill according to claim 1, further comprising a member to close the refill when the refill is not in use.

24. Device for treating hair, comprising:

at least two arms that are able to move relative to one another between a moved-together configuration for treating the hair and a spaced-apart configuration for inserting a lock of hair to be treated between said arms, the refill according to claim 1, the refill being disposed in a removable manner on one of the two arms.

25. The device according to claim 24, wherein the moving together of the arms actuates said pump.

26. The device according to claim 24, wherein the arm carrying the refill has a relief designed to engage with the reservoir in order to cause the internal volume thereof to decrease when the refill is fitted on the device.

27. The device according to claim 24, which is a straightener, wherein each of the two arms comprising a heating element.

* * * * *